US010913266B2

(12) United States Patent
Ogi et al.

(10) Patent No.: US 10,913,266 B2
(45) Date of Patent: Feb. 9, 2021

(54) PRINTING APPARATUS AND INSPECTION METHOD FOR PRINT HEAD

(71) Applicant: CANON KABUSHIKI KAISHA, Tokyo (JP)

(72) Inventors: Kohei Ogi, Yokohama (JP); Hisao Okita, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/367,859

(22) Filed: Mar. 28, 2019

(65) Prior Publication Data

US 2019/0299593 A1 Oct. 3, 2019

(30) Foreign Application Priority Data

Mar. 29, 2018 (JP) ..... 2018-064957

(51) Int. Cl.
*B41J 2/045* (2006.01)

(52) U.S. Cl.
CPC ..... *B41J 2/0457* (2013.01); *B41J 2/0458* (2013.01); *B41J 2/04581* (2013.01)

(58) Field of Classification Search
CPC .... B41J 2/0457; B41J 2/04581; B41J 2/0458; B41J 2/04548; B41J 2/04528
USPC ..... 347/14
See application file for complete search history.

(56) References Cited

U.S. PATENT DOCUMENTS 7,267,429 B2 9/2007 Furukawa
9,643,413 B2 * 5/2017 Teraji ..... B41J 2/04586
2015/0273822 A1 * 10/2015 Teraji ..... B41J 2/04528 347/9

FOREIGN PATENT DOCUMENTS

JP 2005-022408 A 1/2005
JP 2016-221716 A 12/2016

* cited by examiner

*Primary Examiner* — Huan H Tran
*Assistant Examiner* — Alexander D Shenderov
(74) *Attorney, Agent, or Firm* — Venable LLP

(57) ABSTRACT

A printing apparatus that performs printing by using a print head includes a first power supply, a second power supply, and a control unit. The first power supply supplies a first voltage to the print head through a first supply line. The second power supply supplies a second voltage to the print head through a second supply line. The control unit supplies the first voltage from the first power supply without supplying a voltage from the second power supply at the time of an inspection of the print head, and executes a process action concerning a current leakage when a voltage exceeding a predetermined first threshold is generated on the second supply line.

12 Claims, 15 Drawing Sheets

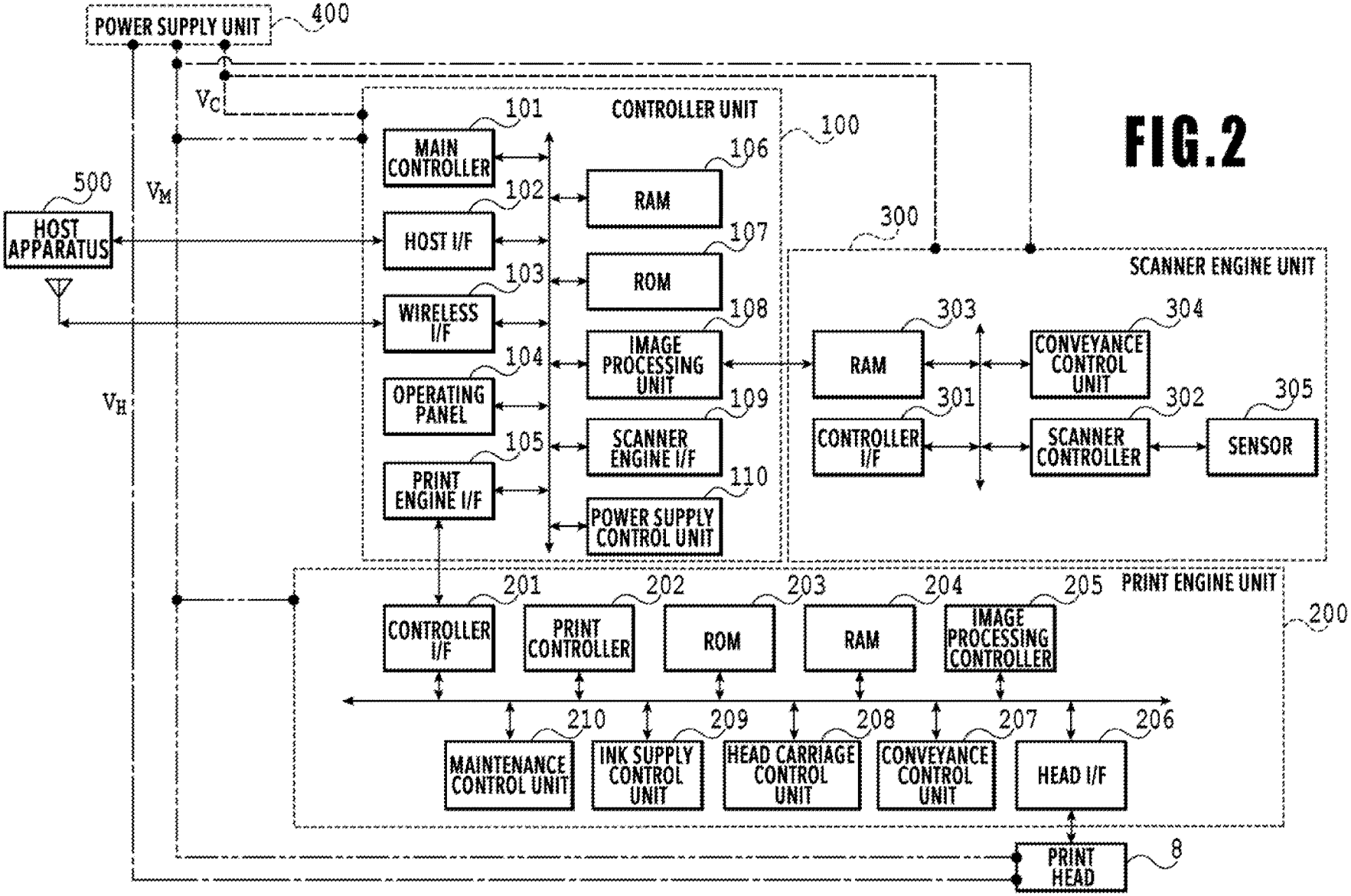
FIG.2
SCANNER ENGINE UNIT
300
SENSOR
305
CONVEYANCE CONTROL UNIT
304
SCANNER CONTROLLER
302
RAM
303
CONTROLLER I/F
301
CONTROLLER UNIT
100
RAM
106
ROM
107
IMAGE PROCESSING UNIT
108
SCANNER ENGINE I/F
109
POWER SUPPLY CONTROL UNIT
110
MAIN CONTROLLER
101
HOST I/F
102
WIRELESS I/F
103
OPERATING PANEL
104
PRINT ENGINE I/F
105
PRINT ENGINE UNIT
200
IMAGE PROCESSING CONTROLLER
205
RAM
204
ROM
203
PRINT CONTROLLER
202
CONTROLLER I/F
201
HEAD I/F
206
CONVEYANCE CONTROL UNIT
207
HEAD CARRIAGE CONTROL UNIT
208
INK SUPPLY CONTROL UNIT
209
MAINTENANCE CONTROL UNIT
210
PRINT HEAD
8
POWER SUPPLY UNIT
400
$V_C$
$V_M$
$V_H$
HOST APPARATUS
500

PRINTING APPARATUS AND INSPECTION METHOD FOR PRINT HEAD

BACKGROUND OF THE INVENTION

Field of the Invention

The present invention relates to a printing apparatus that performs printing by using a print head, and an inspection method for a print head.

Description of the Related Art

Japanese Patent Laid-Open No. 2016-221716 describes a configuration to detect occurrence of a current leakage in a print head by monitoring a voltage on one power supply line connected to the print head.

SUMMARY OF THE INVENTION

Among such print heads, there is one configured to receive different voltages for driving a print head and for operating a logic circuit therein as described in Japanese Patent Laid-Open No. 2005-22408, and there is also one configured to further receive a different voltage for actuating a driver. In the meantime, the need for taking measures against a current leakage between circuits receiving mutually different voltages has been increasing along with the advance in microfabrication of circuits in each print head in recent years.

The present invention provides a printing apparatus and an inspection method for a print head, by which it is possible to reliably detect occurrence of a current leakage in a print head that receives different voltages at a time, and to take measures against the current leakage.

In the first aspect of the present invention, there is provided a printing apparatus configured to perform printing by using a print head, comprising:

a first power supply configured to supply a first voltage to the print head through a first supply line;

a second power supply configured to supply a second voltage to the print head through a second supply line; and a control unit configured to supply the first voltage from the first power supply without supplying a voltage from the second power supply at the time of an inspection of the print head, and to execute a process action concerning a current leakage when a voltage exceeding a predetermined first threshold is generated on the second supply line.

In the second aspect of the present invention, there is provided a printing apparatus configured to perform printing by using a print head, comprising:

a plurality of power supplies configured to supply different voltages to the print head through a plurality of supply lines; and a control unit configured to supply a voltage only from a specific supply line out of the plurality of supply lines to the print head at the time of an inspection of the print head, and to execute a process action on a current leakage when a voltage exceeding a predetermined threshold is generated on a supply line out of the plurality of the supply lines which supplies a higher voltage than the voltage supplied from the specific supply line.

In the third aspect of the present invention, there is provided an inspection method for a print head to which a first voltage is supplied through a first supply line and a second voltage is supplied through a second supply line, comprising:

supplying the first voltage to the print head through the first supply line without supplying a voltage through the second supply line, and detecting occurrence of a current leakage when a voltage exceeding a predetermined first threshold is generated on the second supply line.

According to the present invention, it is possible to detect occurrence of a current leakage and to take measures against the current leakage.

Further features of the present invention will become apparent from the following description of exemplary embodiments with reference to the attached drawings.

BRIEF DESCRIPTION OF THE DRAWINGS

FIG. 2 is a control configuration diagram of the printing apparatus;

FIG. 10 is a diagram showing a relationship between FIG. 10A and FIG. 10B;

DESCRIPTION OF THE EMBODIMENTS

A printing apparatus according to an embodiment of the present invention will be described below with reference to the drawings. It is to be noted that the following embodiment is not intended to limit the scope of the present invention, and a solution of the present invention does not always require a combination of all the features described in the embodiment. Moreover, this embodiment will describe an inkjet printing apparatus as an example of the printing apparatus.

<Regarding Internal Configuration of Printing Apparatus>

Figure 1:
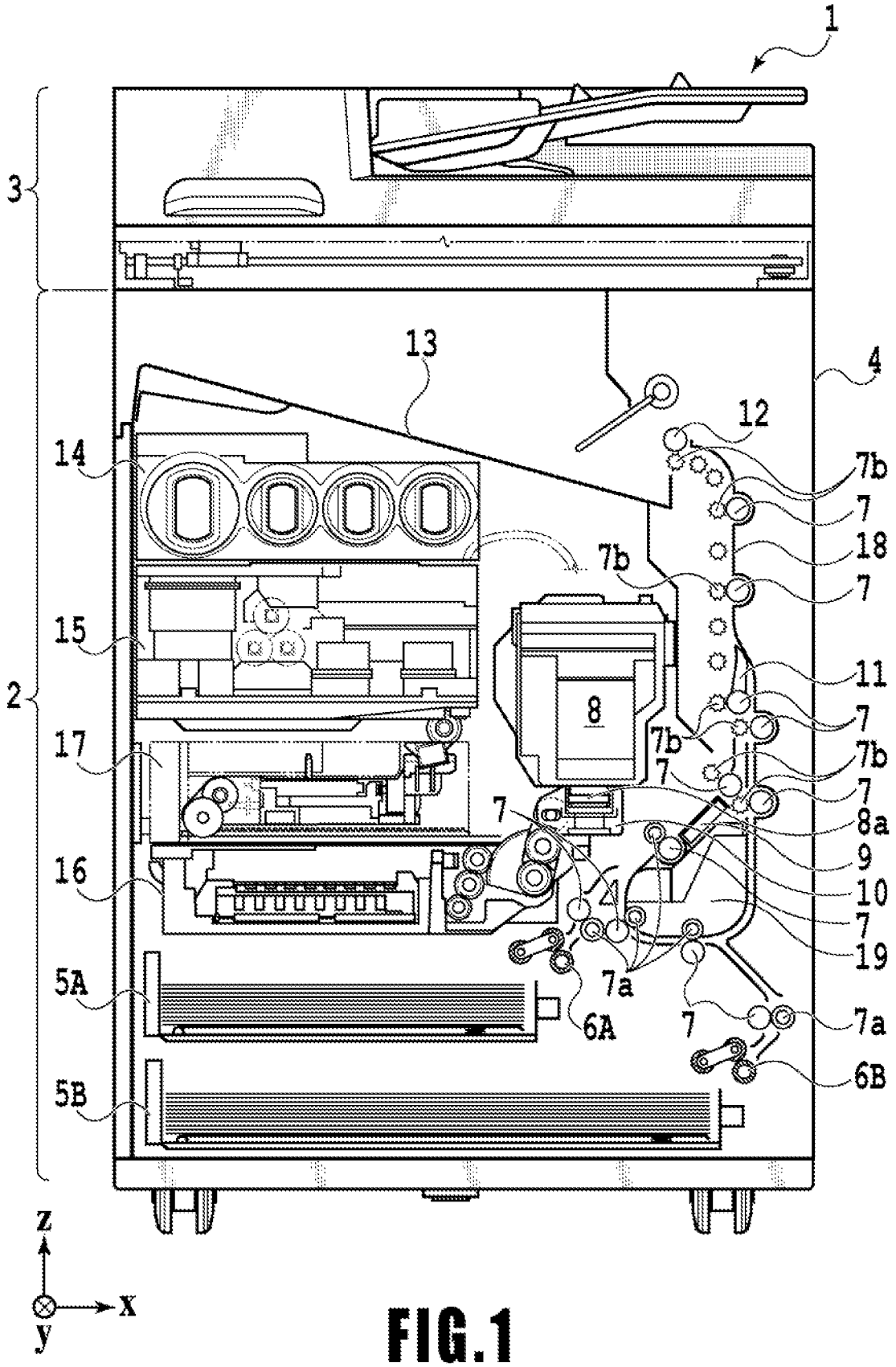
FIG. 1 is a diagram illustrating a printing apparatus in the standby state.

FIG. 1 is an internal configuration diagram of an inkjet printing apparatus 1 (hereinafter "printing apparatus 1") used in the present embodiment. In the drawings, an x-direction is a horizontal direction, a y-direction (a direction perpendicular to paper) is a direction in which ejection openings are arrayed in a print head 8 described later, and a z-direction is a vertical direction.

The printing apparatus 1 is a multifunction printer comprising a print unit 2 and a scanner unit 3. The printing apparatus 1 can use the print unit 2 and the scanner unit 3 separately or in synchronization to perform various processes related to print operation and scan operation. The scanner unit 3 comprises an automatic document feeder (ADF) and a flatbed scanner (FBS) and is capable of scanning a document automatically fed by the ADF as well as scanning a document placed by a user on a document plate of the FBS. The present embodiment is directed to the multifunction printer comprising both the print unit 2 and the scanner unit 3, but the scanner unit 3 may be omitted. FIG. 1 shows the printing apparatus 1 in a standby state in which neither print operation nor scan operation is performed.

In the print unit 2, a first cassette 5A and a second cassette 5B for housing printing medium (cut sheets) S are detachably provided at the bottom of a casing 4 in the vertical direction. Relatively small printing medium of up to A4 size are stacked and housed in the first cassette 5A and relatively large printing medium of up to A3 size are stacked and housed in the second cassette 5B. A first feeding unit 6A for feeding housed printing medium one by one is provided near the first cassette 5A. Similarly, a second feeding unit 6B is provided near the second cassette 5B. In print operation, a print medium S is selectively fed from either one of the cassettes.

Conveying rollers 7, a discharging roller 12, pinch rollers 7*a*, spurs 7*b*, a guide 18, an inner guide 19, and a flapper 11 are conveying mechanisms for guiding a print medium S in a predetermined direction. The conveying rollers 7 are drive rollers located upstream and downstream of the print head 8 and driven by a conveying motor (not shown). The pinch rollers 7*a* are follower rollers that are turned while nipping a print medium S together with the conveying rollers 7. The discharging roller 12 is a drive roller located downstream of the conveying rollers 7 and driven by the conveying motor (not shown). The spurs 7*b* nip and convey a print medium S together with the conveying rollers 7 and discharging roller 12 located downstream of the print head 8.

The guide 18 is provided in a conveying path of a print medium S to guide the print medium S in a predetermined direction. The inner guide 19 is a member extending in the y-direction. The inner guide 19 has a curved side surface and guides a print medium S along the side surface. The flapper 11 is a member for changing a direction in which a print medium S is conveyed in duplex print operation. A discharging tray 13 is a tray for stacking and housing printing medium S that were subjected to print operation and discharged by the discharging roller 12.

The print head 8 of the present embodiment is a full line type color inkjet print head. In the print head 8, a plurality of ejection openings configured to eject ink based on print data are arrayed in the y-direction in FIG. 1 so as to correspond to the width of a print medium S. That is, the print head is configured to eject inks of a plurality of colors. When the print head 8 is in a standby position, an ejection opening surface 8*a* of the print head 8 is oriented vertically downward and capped with a cap unit 10 as shown in FIG. 1. In print operation, the orientation of the print head 8 is changed by a print controller 202 described later such that the ejection opening surface 8*a* faces a platen 9. The platen 9 includes a flat plate extending in the y-direction and supports a print medium S being subjected to print operation by the print head 8 from the back side. The movement of the print head 8 from the standby position to a printing position will be described later in detail.

An ink tank unit 14 separately stores ink of four colors to be supplied to the print head 8. An ink supply unit 15 is provided in the midstream of a flow path connecting the ink tank unit 14 to the print head 8 to adjust the pressure and flow rate of ink in the print head 8 within a suitable range. The present embodiment adopts a circulation type ink supply system, where the ink supply unit 15 adjusts the pressure of ink supplied to the print head 8 and the flow rate of ink collected from the print head 8 within a suitable range.

A maintenance unit 16 comprises the cap unit 10 and a wiping unit 17 and activates them at predetermined timings to perform maintenance operation for the print head 8. The maintenance operation will be described later in detail.

<Regarding Control Configuration in Printing Apparatus>

FIG. 2 is a block diagram showing a control configuration in the printing apparatus 1. The control configuration mainly includes a print engine unit 200 that exercises control over the print unit 2, a scanner engine unit 300 that exercises control over the scanner unit 3, a power supply unit 400, and a controller unit 100 that exercises control over the entire printing apparatus 1. A print controller 202 controls various mechanisms of the print engine unit 200 under instructions from a main controller 101 of the controller unit 100. Various mechanisms of the scanner engine unit 300 are controlled by the main controller 101 of the controller unit 100. The control configuration will be described below in detail.

In the controller unit 100, the main controller 101 including a CPU controls the entire printing apparatus 1 using a RAM 106 as a work area in accordance with various parameters and programs stored in a ROM 107. For example, when a print job is input from a host apparatus 500 via a host I/F 102 or a wireless I/F 103, an image processing unit 108 executes predetermined image processing for received image data under instructions from the main controller 101. The main controller 101 transmits the image data subjected to the image processing to the print engine unit 200 via a print engine I/F 105.

The printing apparatus 1 may acquire image data from the host apparatus 500 via a wireless or wired communication or acquire image data from an external storage unit (such as a USB memory) connected to the printing apparatus 1. A communication system used for the wireless or wired communication is not limited. For example, as a communication system for the wireless communication, Wi-Fi (Wireless Fidelity; registered trademark) and Bluetooth (registered trademark) can be used. As a communication system for the wired communication, a USB (Universal Serial Bus) and the like can be used. For example, when a scan command is input from the host apparatus 500, the main controller 101 transmits the command to the scanner unit 3 via a scanner engine I/F 109.

An operating panel 104 is a mechanism to allow a user to do input and output for the printing apparatus 1. A user can give an instruction to perform operation such as copying and scanning, set a print mode, and recognize information about the printing apparatus 1 via the operating panel 104.

In the controller unit 100, a power supply control unit 110 controls a power supply (electric power) supplied from the power supply unit 400. The power supply control unit 110 is equipped with a timer and is configured to perform control in such a way as to shut down the power supply in response to either completion of preparation for terminating a process being executed or completion of measurement of a predetermined count time period (a set time period) by using the timer.

Here, the count time period to be set to the timer is set depending on the process being executed by any of the print engine unit 200, the scanner engine unit 300, and the like.

In the print engine unit 200, the print controller 202 including a CPU controls various mechanisms of the print unit 2 using a RAM 204 as a work area in accordance with various parameters and programs stored in a ROM 203. When various commands and image data are received via a controller I/F 201, the print controller 202 temporarily stores them in the RAM 204. The print controller 202 allows an image processing controller 205 to convert the stored image data into print data such that the print head 8 can use it for print operation. After the generation of the print data, the print controller 202 allows the print head 8 to perform print operation based on the print data via a head I/F 206. At this time, the print controller 202 conveys a print medium S by driving the feeding units 6A and 6B, conveying rollers 7, discharging roller 12, and flapper 11 shown in FIG. 1 via a conveyance control unit 207. The print head 8 performs print operation in synchronization with the conveyance operation of the print medium S under instructions from the print controller 202, thereby performing printing.

A head carriage control unit 208 changes the orientation and position of the print head 8 in accordance with an operating state of the printing apparatus 1 such as a maintenance state or a printing state. An ink supply control unit 209 controls the ink supply unit 15 such that the pressure of ink supplied to the print head 8 is within a suitable range. A maintenance control unit 210 controls the operation of the cap unit 10 and wiping unit 17 in the maintenance unit 16 when performing maintenance operation for the print head 8.

In the scanner engine unit 300, the main controller 101 controls hardware resources of the scanner controller 302 using the RAM 106 as a work area in accordance with various parameters and programs stored in the ROM 107, thereby controlling various mechanisms of the scanner unit 3. For example, the main controller 101 controls hardware resources in the scanner controller 302 via a controller I/F 301 to cause a conveyance control unit 304 to convey a document placed by a user on the ADF and cause a sensor 305 to scan the document. The scanner controller 302 stores scanned image data in a RAM 303. The print controller 202 can convert the image data acquired as described above into print data to enable the print head 8 to perform print operation based on the image data scanned by the scanner controller 302.

The power supply unit 400 is a unit to supply the power supplies to the respective units. The power supply unit 400 supplies a power supply $V_C$ (about 3.3 V) to the controller unit 100 and the scanner engine unit 300. Meanwhile, the power supply unit 400 supplies a power supply $V_M$ (about 30.8 V) to the controller unit 100, the print engine unit 200, the scanner engine unit 300, and the print head 8, and also supplies a power supply $V_H$ (about 28 V) to the print head 8.

<Regarding Operation of Printing Apparatus in Printing State>

Figure 3:
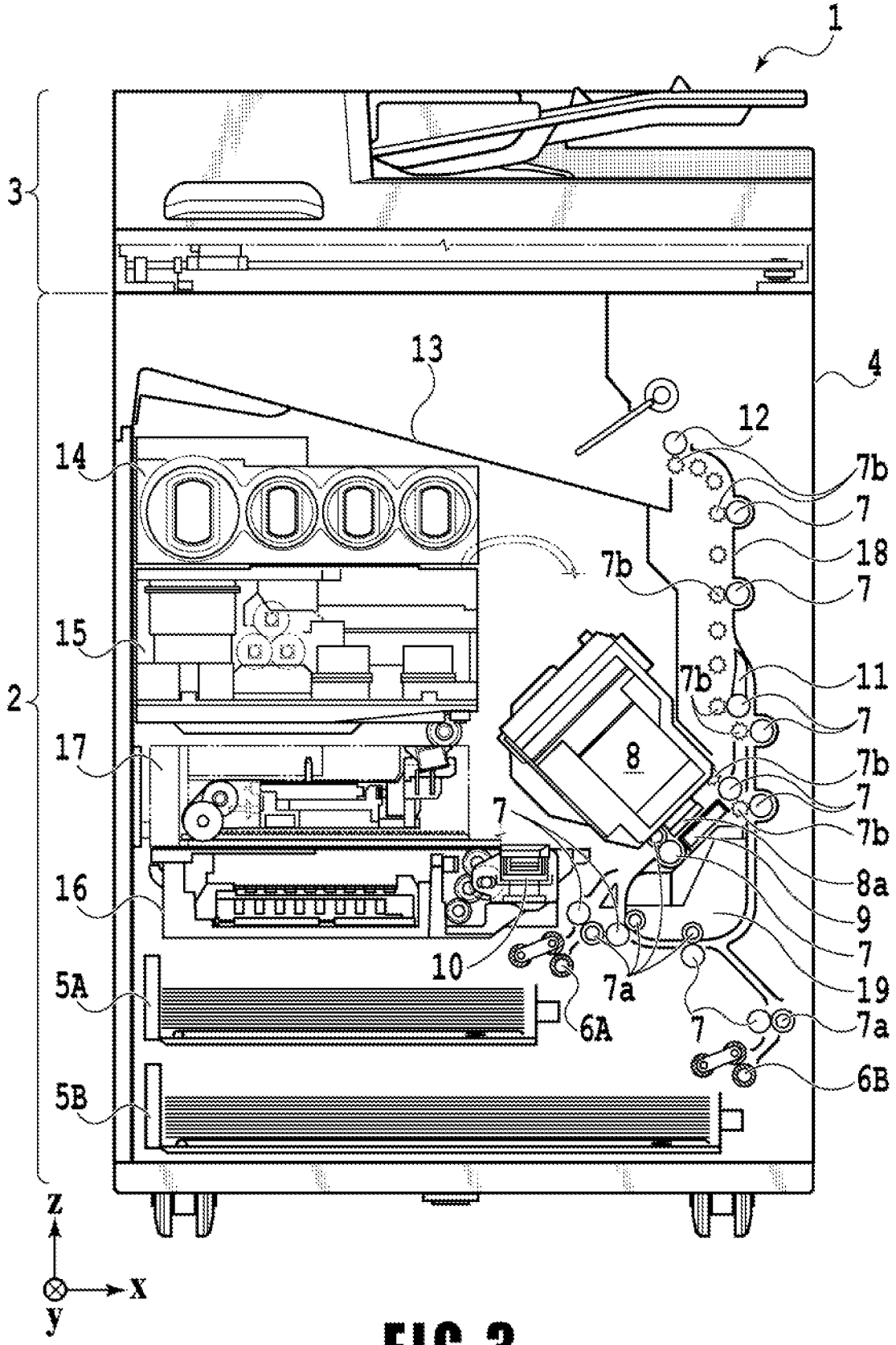
FIG. 3 is a diagram illustrating the printing apparatus in the printing state.

FIG. 3 shows the printing apparatus 1 in a printing state. As compared with the standby state shown in FIG. 1, the cap unit 10 is separated from the ejection opening surface 8*a* of the print head 8 and the ejection opening surface 8*a* faces the platen 9. In the present embodiment, the plane of the platen 9 is inclined about 45° with respect to the horizontal plane. The ejection opening surface 8*a* of the print head 8 in a printing position is also inclined about 45° with respect to the horizontal plane so as to keep a constant distance from the platen 9.

In the case of moving the print head 8 from the standby position shown in FIG. 1 to the printing position shown in FIG. 3, the print controller 202 uses the maintenance control unit 210 to move the cap unit 10 down to an evacuation position shown in FIG. 3, thereby separating the cap member 10*a* from the ejection opening surface 8*a* of the print head 8. The print controller 202 then uses the head carriage control unit 208 to turn the print head 8 45° while adjusting the vertical height of the print head 8 such that the ejection opening surface 8*a* faces the platen 9. After the completion of print operation, the print controller 202 reverses the above procedure to move the print head 8 from the printing position to the standby position.

Next, a conveying path of a print medium S in the print unit 2 will be described. When a print command is input, the print controller 202 first uses the maintenance control unit 210 and the head carriage control unit 208 to move the print head 8 to the printing position shown in FIG. 3. The print controller 202 then uses the conveyance control unit 207 to drive either the first feeding unit 6A or the second feeding unit 6B in accordance with the print command and feed a print medium S.

Figure 4C:
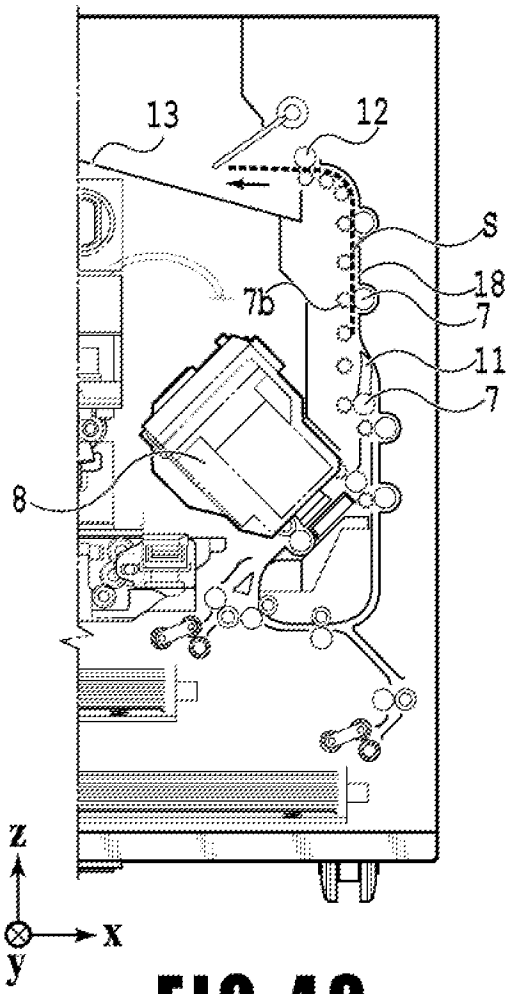
FIGS. 4A to 4C are diagrams illustrating the conveyance path of a print medium fed from a first cassette.
Figure 4B:
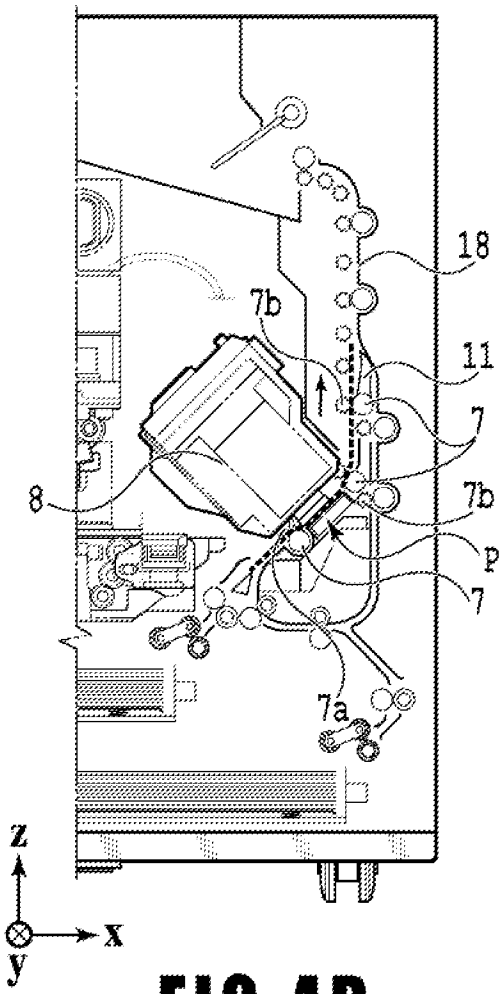
Figure 4A:
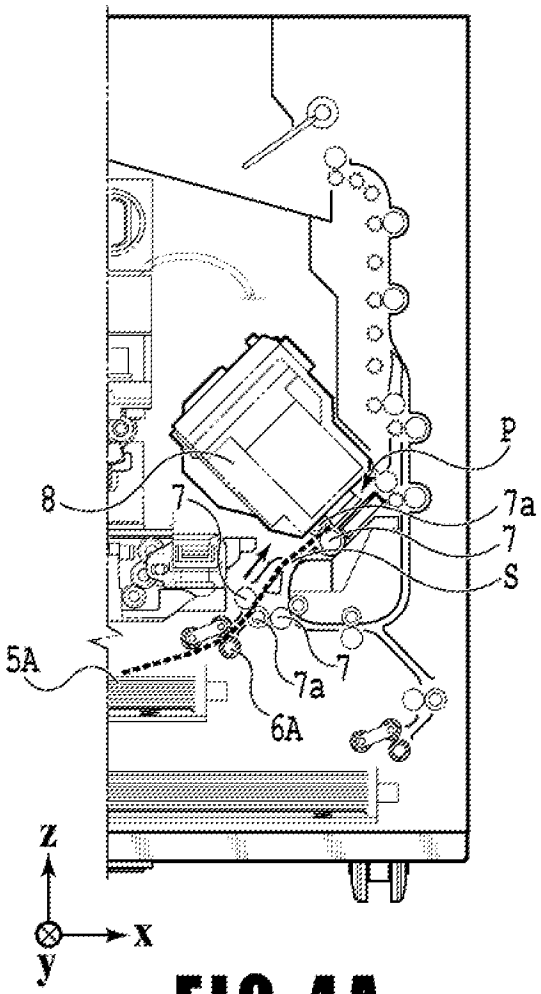

FIGS. 4A to 4C are diagrams showing a conveying path in the case of feeding an A4 size print medium S from the first cassette 5A. A print medium S at the top of a stack of printing medium in the first cassette 5A is separated from the rest of the stack by the first feeding unit 6A and conveyed toward a print area P between the platen 9 and the print head 8 while being nipped between the conveying rollers 7 and the pinch rollers 7*a*. FIG. 4A shows a conveying state where the front end of the print medium S is about to reach the print area P. The direction of movement of the print medium S is changed from the horizontal direction (x-direction) to a direction inclined about 45° with respect to the horizontal direction while being fed by the first feeding unit 6A to reach the print area P.

In the print area P, a plurality of ejection openings provided in the print head 8 eject ink toward the print medium S. In an area where ink is applied to the print medium S, the back side of the print medium S is supported by the platen 9 so as to keep a constant distance between the ejection opening surface 8*a* and the print medium S. After ink is applied to the print medium S, the conveying rollers 7 and the spurs 7*b* guide the print medium S such that the print medium S passes on the left of the flapper 11 with its tip inclined to the right and is conveyed along the guide 18 in the vertically upward direction of the printing apparatus 1. FIG. 4B shows a state where the front end of the print medium S has passed through the print area P and the print medium S is being conveyed vertically upward. The conveying rollers 7 and the spurs 7*b* change the direction of movement of the print medium S from the direction inclined about 45° with respect to the horizontal direction in the print area P to the vertically upward direction.

After being conveyed vertically upward, the print medium S is discharged into the discharging tray 13 by the discharging roller 12 and the spurs 7*b*. FIG. 4C shows a state where the front end of the print medium S has passed through the discharging roller 12 and the print medium S is being discharged into the discharging tray 13. The discharged print medium S is held in the discharging tray 13 with the side on which an image was printed by the print head 8 down.

Figure 5C:
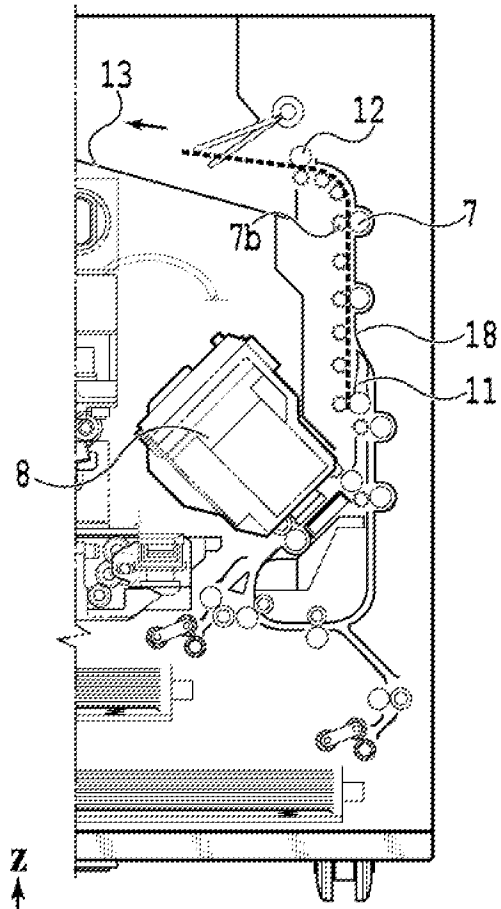
FIGS. 5A to 5C are diagrams illustrating the conveyance path of a print medium fed from a second cassette.
Figure 5B:
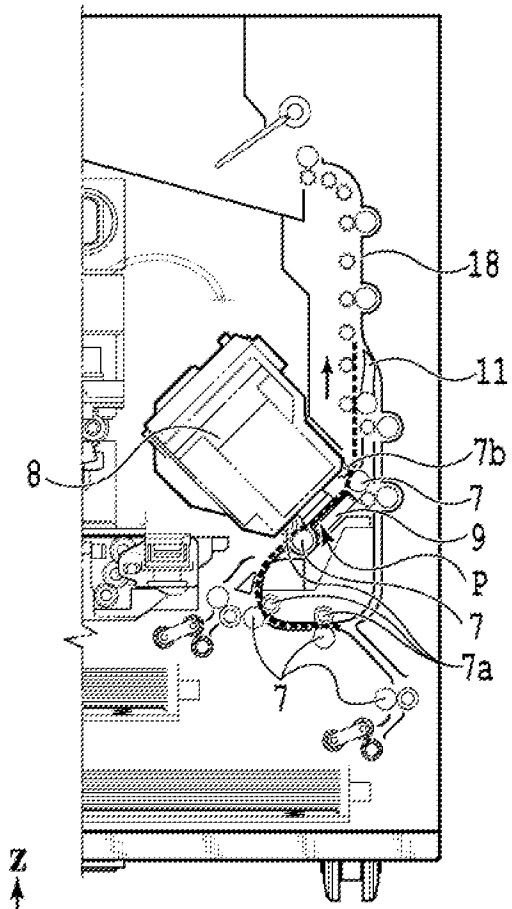
Figure 5A:
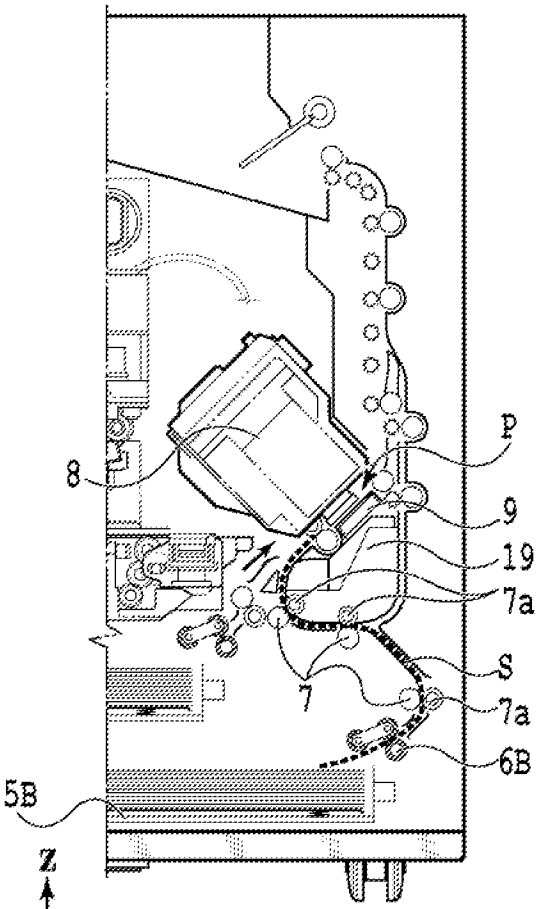

FIGS. 5A to 5C are diagrams showing a conveying path in the case of feeding an A3 size print medium S from the second cassette 5B. A print medium S at the top of a stack of printing medium in the second cassette 5B is separated from the rest of the stack by the second feeding unit 6B and conveyed toward the print area P between the platen 9 and the print head 8 while being nipped between the conveying rollers 7 and the pinch rollers 7*a*.

FIG. 5A shows a conveying state where the front end of the print medium S is about to reach the print area P. In a part of the conveying path, through which the print medium S is fed by the second feeding unit 6B toward the print area P, the plurality of conveying rollers 7, the plurality of pinch rollers 7*a*, and the inner guide 19 are provided such that the print medium S is conveyed to the platen 9 while being bent into an S-shape.

The rest of the conveying path is the same as that in the case of the A4 size print medium S shown in FIGS. 4B and 4C. FIG. 5B shows a state where the front end of the print medium S has passed through the print area P and the print medium S is being conveyed vertically upward. FIG. 5C shows a state where the front end of the print medium S has passed through the discharging roller 12 and the print medium S is being discharged into the discharging tray 13.

FIGS. 6A to 6D show a conveying path in the case of performing print operation (duplex printing) for the back side (second side) of an A4 size print medium S. In the case of duplex printing, print operation is first performed for the first side (front side) and then performed for the second side (back side). A conveying procedure during print operation for the first side is the same as that shown in FIGS. 4A to 4C and therefore description will be omitted. A conveying procedure subsequent to FIG. 4C will be described below.

Figures 6A, 6B, 6C, 6D:
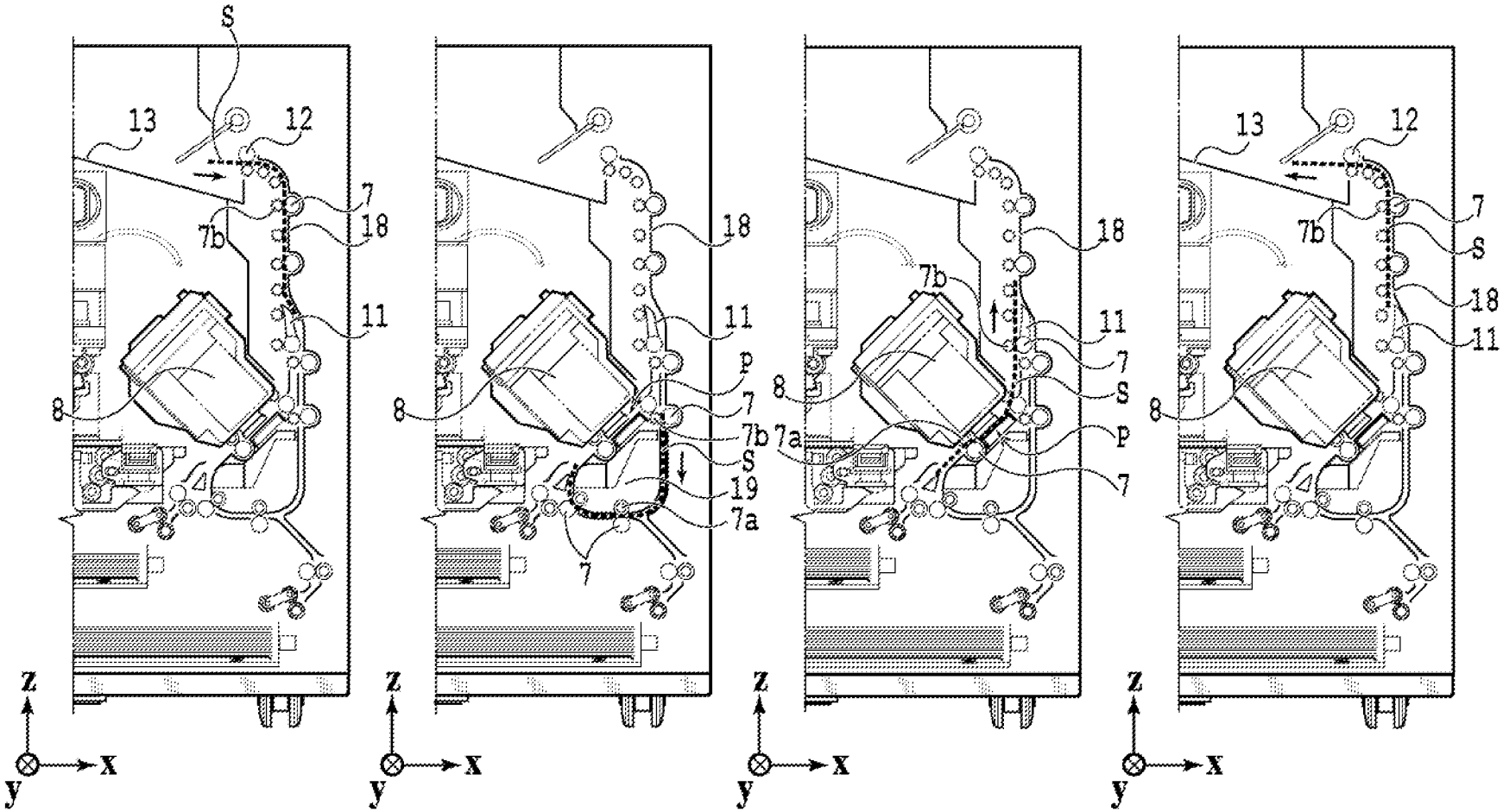
FIGS. 6A to 6D are diagrams illustrating the conveyance path in the case where print operation is performed on the back surface of a print medium.

After the print head 8 finishes print operation for the first side and the back end of the print medium S passes by the flapper 11, the print controller 202 turns the conveying rollers 7 backward to convey the print medium S into the printing apparatus 1. At this time, since the flapper 11 is controlled by an actuator (not shown) such that the tip of the flapper 11 is inclined to the left, the front end of the print medium S (corresponding to the back end during the print operation for the first side) passes on the right of the flapper 11 and is conveyed vertically downward. FIG. 6A shows a state where the front end of the print medium S (corresponding to the back end during the print operation for the first side) is passing on the right of the flapper 11.

Then, the print medium S is conveyed along the curved outer surface of the inner guide 19 and then conveyed again to the print area P between the print head 8 and the platen 9. At this time, the second side of the print medium S faces the ejection opening surface 8*a* of the print head 8. FIG. 6B shows a conveying state where the front end of the print medium S is about to reach the print area P for print operation for the second side.

The rest of the conveying path is the same as that in the case of the print operation for the first side shown in FIGS. 4B and 4C. FIG. 6C shows a state where the front end of the print medium S has passed through the print area P and the print medium S is being conveyed vertically upward. At this time, the flapper 11 is controlled by the actuator (not shown) such that the tip of the flapper 11 is inclined to the right. FIG. 6D shows a state where the front end of the print medium S has passed through the discharging roller 12 and the print medium S is being discharged into the discharging tray 13.

<Regarding Maintenance Operation for Print Head>

Next, maintenance operation for the print head 8 will be described. As described with reference to FIG. 1, the maintenance unit 16 of the present embodiment comprises the cap unit 10 and the wiping unit 17 and activates them at predetermined timings to perform maintenance operation.

Figure 7:
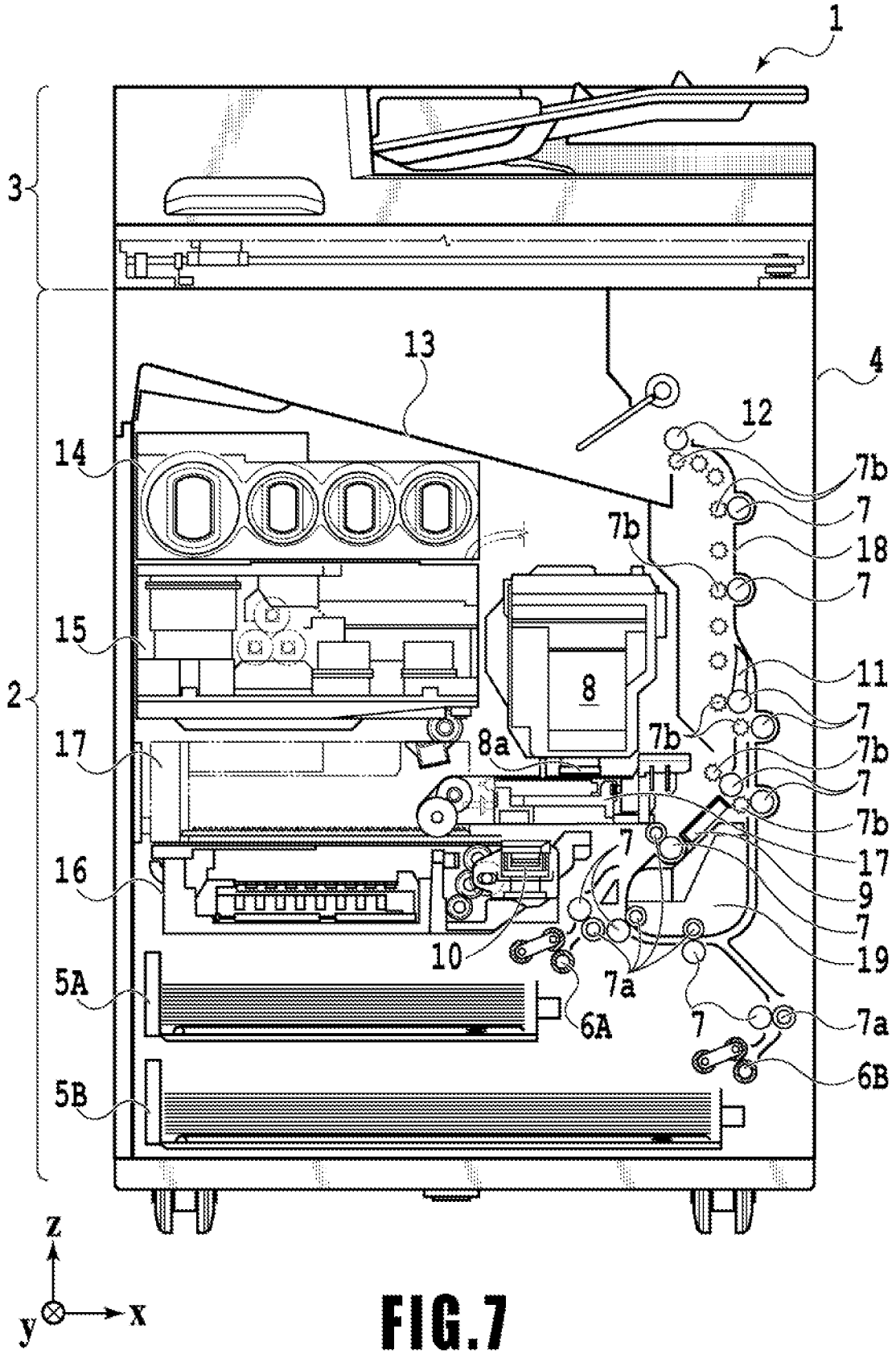
FIG. 7 is a diagram illustrating the printing apparatus in the maintenance state.

FIG. 7 is a diagram showing the printing apparatus 1 in a maintenance state. In the case of moving the print head 8 from the standby position shown in FIG. 1 to a maintenance position shown in FIG. 7, the print controller 202 moves the print head 8 vertically upward and moves the cap unit 10 vertically downward. The print controller 202 then moves the wiping unit 17 from the evacuation position to the right in FIG. 7. After that, the print controller 202 moves the print head 8 vertically downward to the maintenance position where maintenance operation can be performed.

On the other hand, in the case of moving the print head 8 from the printing position shown in FIG. 3 to the maintenance position shown in FIG. 7, the print controller 202 moves the print head 8 vertically upward while turning it 45°. The print controller 202 then moves the wiping unit 17 from the evacuation position to the right. Following that, the print controller 202 moves the print head 8 vertically downward to the maintenance position where maintenance operation can be performed.

Figure 8A:
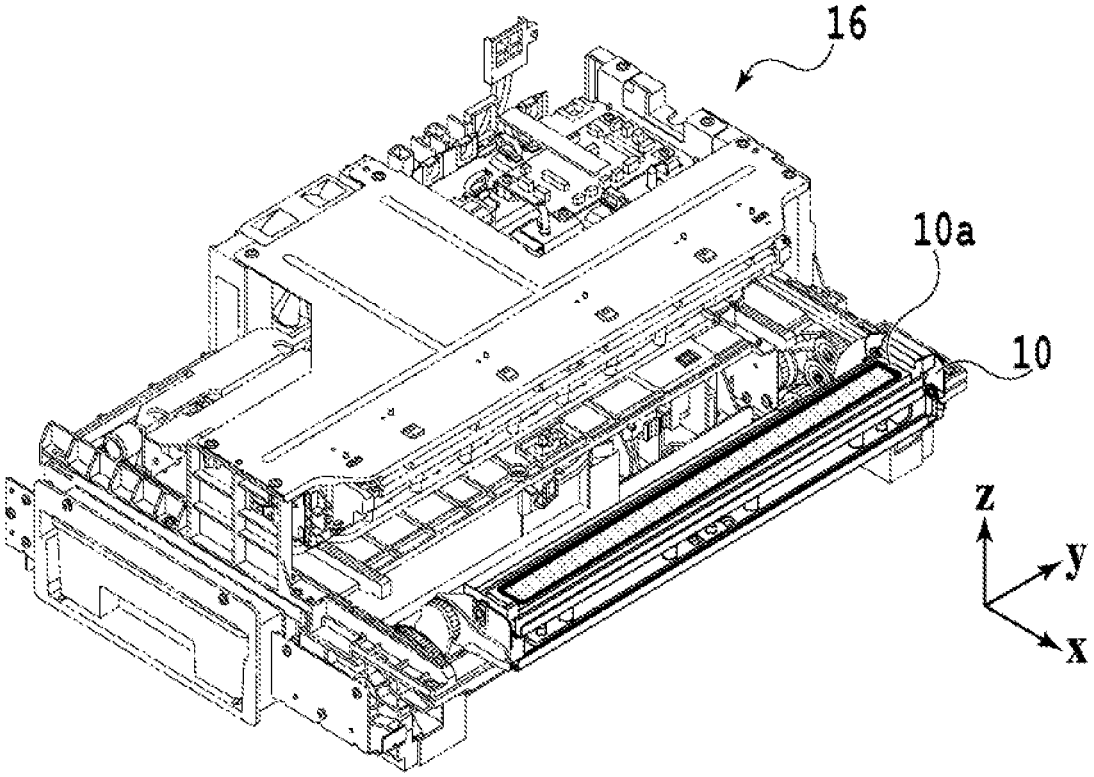
FIGS. 8A and 8B are perspective views of the structure of a maintenance unit.
Figure 8B:
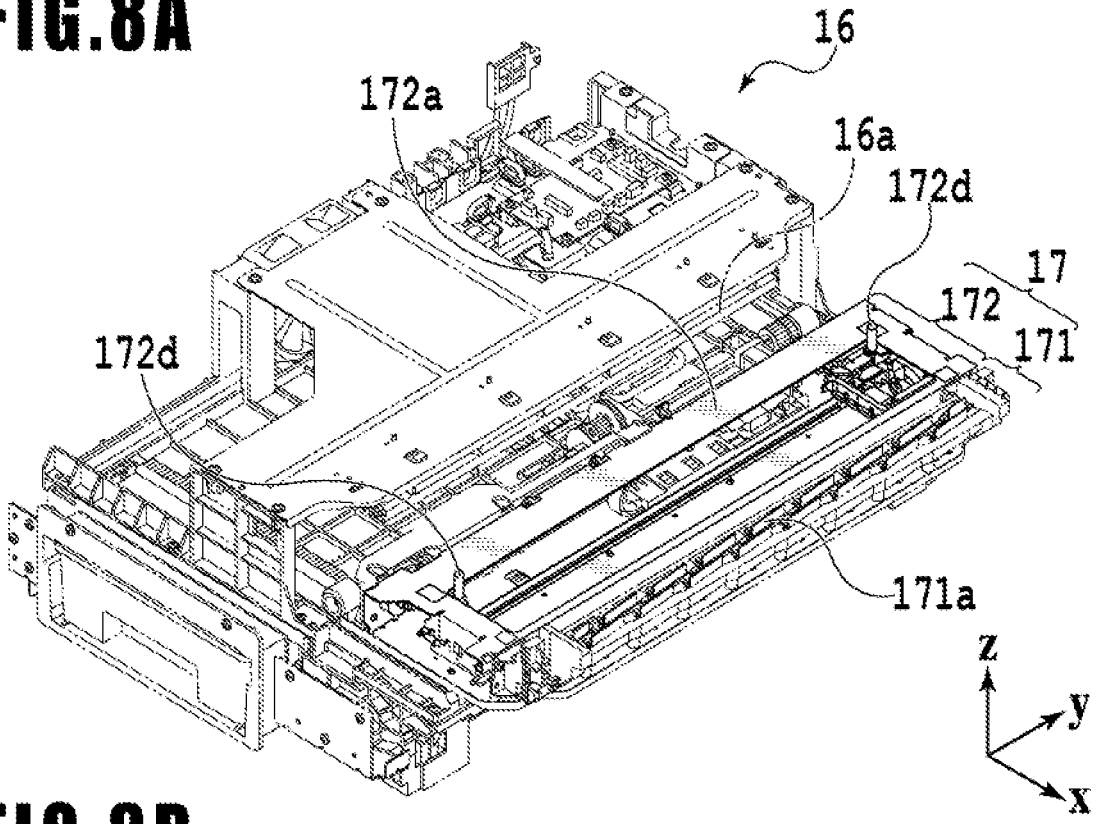

FIG. 8A is a perspective view showing the maintenance unit 16 in a standby position. FIG. 8B is a perspective view showing the maintenance unit 16 in a maintenance position. FIG. 8A corresponds to FIG. 1 and FIG. 8B corresponds to FIG. 7. When the print head 8 is in the standby position, the maintenance unit 16 is in the standby position shown in FIG. 8A, the cap unit 10 has been moved vertically upward, and the wiping unit 17 is housed in the maintenance unit 16. The cap unit 10 comprises a box-shaped cap member 10*a* extending in the y-direction. The cap member 10*a* can be brought into intimate contact with the ejection opening surface 8*a* of the print head 8 to prevent ink from evaporating from the ejection openings. The cap unit 10 also has the function of collecting ink ejected to the cap member 10*a* for preliminary ejection or the like and allowing a suction pump (not shown) to suck the collected ink.

On the other hand, in the maintenance position shown in FIG. 8B, the cap unit 10 has been moved vertically downward and the wiping unit 17 has been drawn from the maintenance unit 16. The wiping unit 17 comprises two wiper units: a blade wiper unit 171 and a vacuum wiper unit 172.

In the blade wiper unit 171, blade wipers 171*a* for wiping the ejection opening surface 8*a* in the x-direction are provided in the y-direction along the length of an area where the ejection openings are arrayed. In the case of performing wiping operation by the use of the blade wiper unit 171, the wiping unit 17 moves the blade wiper unit 171 in the x-direction while the print head 8 is positioned at a height at which the print head 8 can be in contact with the blade wipers 171*a*. This movement enables the blade wipers 171*a* to wipe ink and the like adhering to the ejection opening surface 8*a*.

The entrance of the maintenance unit 16 through which the blade wipers 171*a* are housed is equipped with a wet wiper cleaner 16*a* for removing ink adhering to the blade wipers 171*a* and applying a wetting liquid to the blade wipers 171*a*. The wet wiper cleaner 16*a* removes substances adhering to the blade wipers 171*a* and applies the wetting liquid to the blade wipers 171*a* each time the blade wipers 171*a* are inserted into the maintenance unit 16. The wetting liquid is transferred to the ejection opening surface 8*a* in the next wiping operation for the ejection opening surface 8*a*, thereby facilitating sliding between the ejection opening surface 8*a* and the blade wipers 171*a*.

The vacuum wiper unit 172 comprises a flat plate 172*a* having an opening extending in the y-direction, a carriage 172*b* movable in the y-direction within the opening, and a vacuum wiper 172*c* mounted on the carriage 172*b*. The vacuum wiper 172*c* is provided to wipe the ejection opening surface 8*a* in the y-direction along with the movement of the carriage 172*b*. The tip of the vacuum wiper 172*c* has a suction opening connected to the suction pump (not shown). Accordingly, if the carriage 172*b* is moved in the y-direction while operating the suction pump, ink and the like adhering to the ejection opening surface 8*a* of the print head 8 are wiped and gathered by the vacuum wiper 172*c* and sucked into the suction opening. At this time, the flat plate 172*a* and a dowel pin 172*d* provided at both ends of the opening are used to align the ejection opening surface 8*a* with the vacuum wiper 172*c*.

In the present embodiment, it is possible to carry out a first wiping process in which the blade wiper unit 171 performs wiping operation and the vacuum wiper unit 172 does not perform wiping operation and a second wiping process in which both the wiper units sequentially perform wiping operation. In the case of the first wiping process, the print controller 202 first draws the wiping unit 17 from the maintenance unit 16 while the print head 8 is evacuated vertically above the maintenance position shown in FIG. 7. The print controller 202 moves the print head 8 vertically downward to a position where the print head 8 can be in contact with the blade wipers 171*a* and then moves the wiping unit 17 into the maintenance unit 16. This movement enables the blade wipers 171*a* to wipe ink and the like adhering to the ejection opening surface 8*a*. That is, the blade wipers 171*a* wipe the ejection opening surface 8*a* when moving from a position drawn from the maintenance unit 16 into the maintenance unit 16.

After the blade wiper unit 171 is housed, the print controller 202 moves the cap unit 10 vertically upward and brings the cap member 10*a* into intimate contact with the ejection opening surface 8*a* of the print head 8. In this state, the print controller 202 drives the print head 8 to perform preliminary ejection and allows the suction pump to suck ink collected in the cap member 10*a*.

In the case of the second wiping process, the print controller 202 first slides the wiping unit 17 to draw it from the maintenance unit 16 while the print head 8 is evacuated vertically above the maintenance position shown in FIG. 7. The print controller 202 moves the print head 8 vertically downward to the position where the print head 8 can be in contact with the blade wipers 171*a* and then moves the wiping unit 17 into the maintenance unit 16. This movement enables the blade wipers 171*a* to perform wiping operation for the ejection opening surface 8*a*. Next, the print controller 202 slides the wiping unit 17 to draw it from the maintenance unit 16 to a predetermined position while the print head 8 is evacuated again vertically above the maintenance position shown in FIG. 7. Then, the print controller 202 uses the flat plate 172*a* and the dowel pins 172*d* to align the ejection opening surface 8*a* with the vacuum wiper unit 172 while moving the print head 8 down to a wiping position shown in FIG. 7. After that, the print controller 202 allows the vacuum wiper unit 172 to perform the wiping operation described above. After evacuating the print head 8 vertically upward and housing the wiping unit 17, the print controller 202 allows the cap unit 10 to perform preliminary ejection into the cap member 10*a* and suction operation of collected ink in the same manner as the first wiping process.

<Regarding Detection of Current Leakage>

Figure 9:
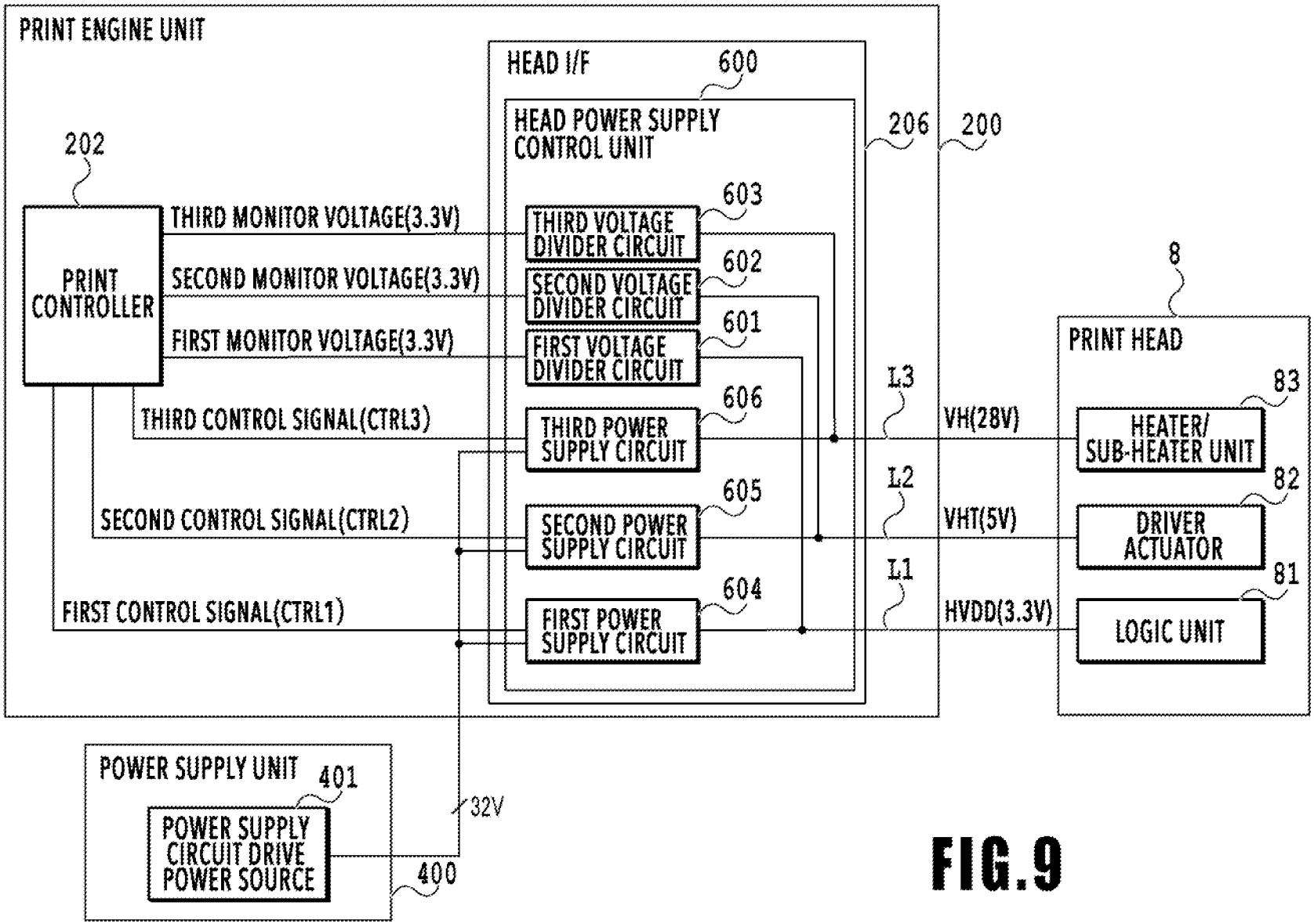
FIG. 9 is an explanatory diagram of power supply circuits in the printing apparatus.

FIG. 9 is an explanatory diagram of a configuration for detecting a current leakage (a sneak current) in the print head 8.

The print head 8 includes a heater/sub-heater unit 83, a driver actuator 82, and a logic unit 81. The heater/sub-heater unit 83 includes heaters (thermoelectric conversion elements) serving as ejection energy generation elements for ejecting ink from the ejection openings, and sub-heaters for performing temperature adjustment of the print head 8. The heat generated by each heater serving as the ejection energy generation element vaporizes ink, and ink is ejected from the ejection opening by use of the vaporization energy. Besides the heaters, various other elements such as piezoelectric elements are also applicable to the ejection energy generation elements. The driver actuator 82 includes drive transistors for driving the heaters and sub-heaters while the logic unit 81 includes a logic circuit for controlling the drive transistors. A head power supply control unit 600 included in the head interface (head I/F) 206 generates three levels of power supply voltages VH, VHT, and HVDD to be supplied (applied) to the print head 8. The power supply voltage VH (a third voltage) is 28 V and supplied to the heater/sub-heater unit 83 for driving the heaters and the sub-heaters. The power supply voltage VHT (a second voltage) is 5 V and supplied to the driver actuator 82 for actuating drivers of the heaters and the sub-heaters. The power supply voltage HVDD (a first voltage) is 3.3 V and supplied to the logic unit 81 for driving the logic circuit.

A power supply circuit drive power source 401 supplies the power supply voltages to a first power supply circuit 604, a second power supply circuit 605, and a third power supply circuit 606 in the head power supply control unit 600. The first power supply circuit 604 steps down the voltage at 32 V supplied from the power source 401 of the power supply unit 400 by using a DC/DC converter to generate the HVDD at 3.3 V, and supplies the HVDD to the logic unit 81 through a first supply line L1. The second power supply circuit 605 steps down the voltage at 32 V supplied from the power source 401 by using the DC/DC converter to generate 6 V, and further steps down the voltage at 6 V with a regulator to generate the VHT at 5 V. Then, the VHT is supplied to the driver actuator 82 through a second supply line L2. The third power supply circuit 606 steps down the voltage at 32 V supplied from the power source 401 by using a special IC to generate the VH at 28 V, and supplies the VH to the heater/sub-heater unit 83 through a third supply line L3. The HVDD is divided into 3.3 V with a first voltage divider circuit 601 and the divided voltage (a first monitor voltage) is monitored by the print controller 202. The VHT is divided into 3.3 V with a second voltage divider circuit 602 and the divided voltage (a second monitor voltage) is monitored by the print controller 202. The VH is divided into 3.3 V with a third voltage divider circuit 603 and the divided voltage (a third monitor voltage) is monitored by the print controller 202. As described later, the print controller 202 monitors the divided voltages, and thus determines whether or not a current leakage is taking place. Meanwhile, the above-mentioned voltage division makes it possible to protect the print controller 202 by preventing an input of a high voltage to the print controller 202 during the supply of the HVDD, the VHT, and the VH and in the event of a current leakage. Although illustration is omitted, multiple GND are located between the head I/F 206 and the print head 8.

Figure 10A:
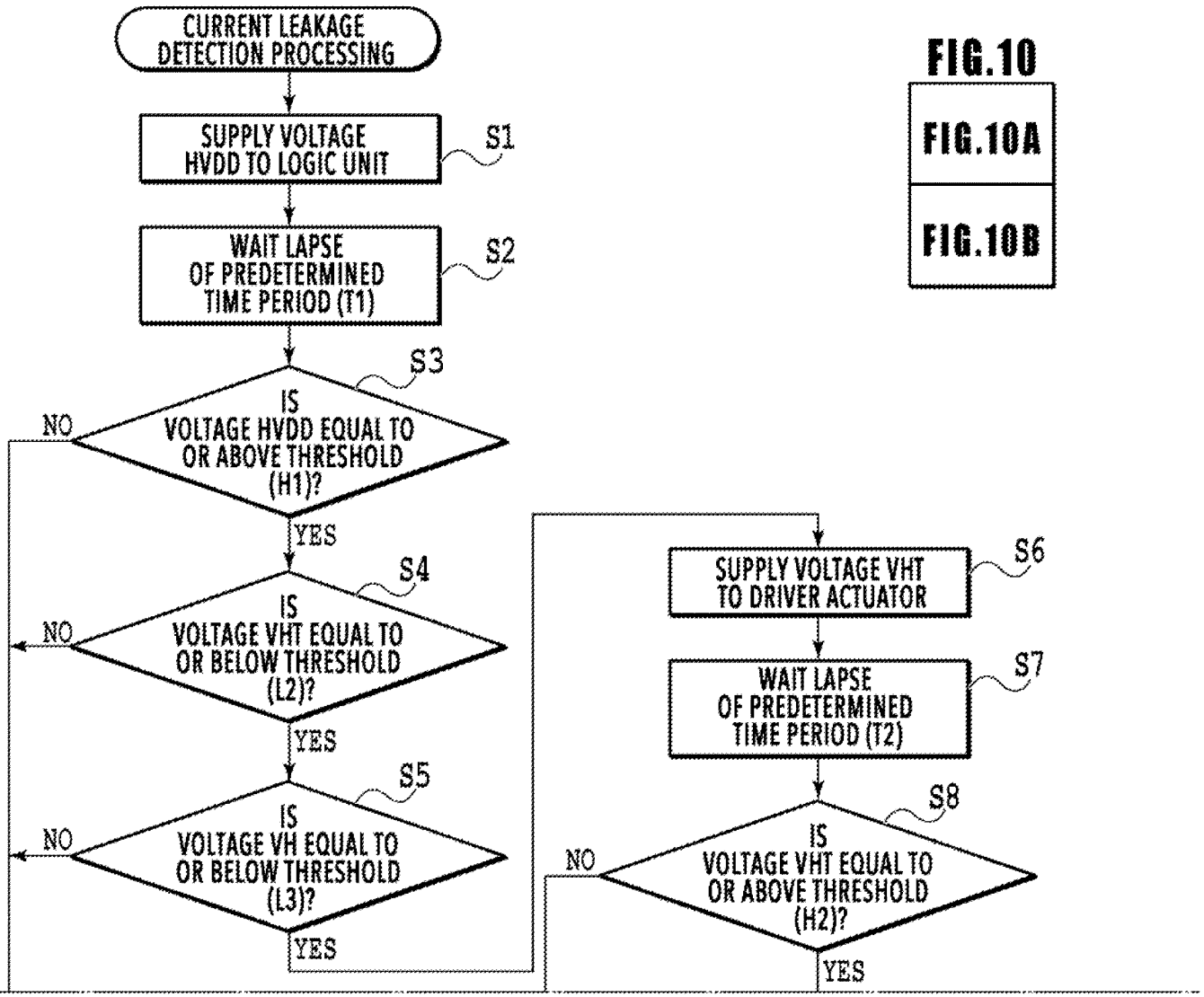
FIGS. 10A and 10B are flowcharts for explaining a process to detect a current leakage.
Figure 10B:
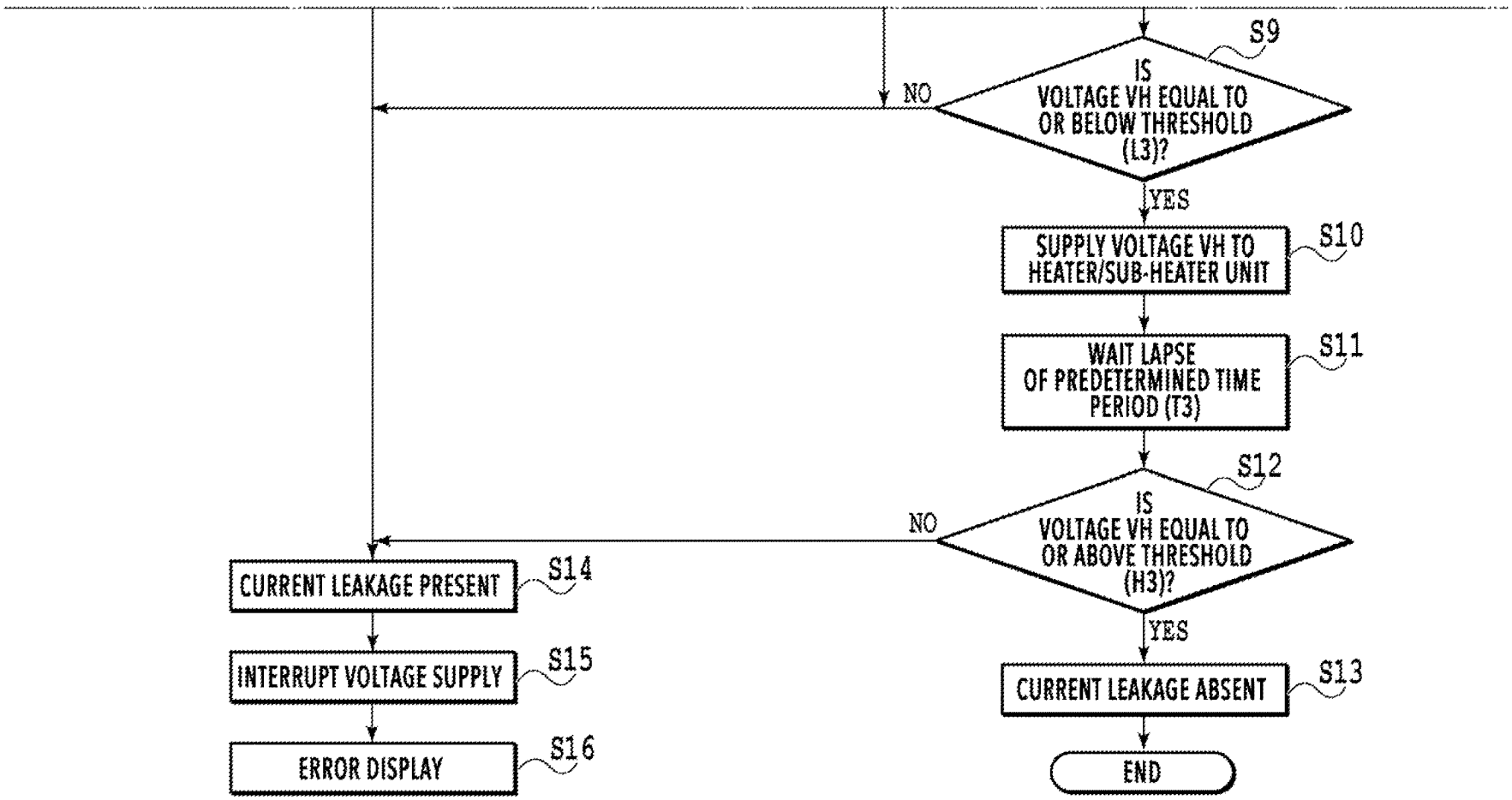

FIGS. 10A and 10B are flowcharts for explaining a process to detect a current leakage by using the print controller 202. Program codes stored in the ROM are developed in the RAM, and the CPU executes the program codes to carry out a series of the process shown in FIGS. 10A and 10B. Alternatively, part or all of functions of the steps in FIGS. 10A and 10B may be realized by using hardware such as an ASIC and an electronic circuit. Here, the sign "S" associated with description of each procedure stands for a step.

First, the print controller 202 supplies the voltage HVDD (3.3 V) to the logic unit 81 by using the first supply line L1 as a specified supply line (S1). Then, after a lapse of a time period (T1) necessary for rise of the voltage HVDD (S2), the print controller 202 determines whether or not the voltage HVDD is equal to or above a predetermined threshold H1 (see FIG. 11) (S3). Specifically, the print controller 202 determines whether or not the first monitor voltage inputted from the first voltage divider circuit 601 is equal to or above a predetermined level H (which corresponds to the threshold H1). Note that S3 is executed in order to detect a current leakage between a power supply circuit of the logic unit 81 and the GND. When the print controller 202 determines that the voltage HVDD is equal to or above the threshold H1, the print controller 202 determines whether or not the voltage VHT is equal to or below a predetermined threshold L2 (see FIG. 11) (S4). Specifically, the print controller 202 determines whether or not the second monitor voltage inputted from the second voltage divider circuit 602 is equal to or below a predetermined level L (which corresponds to the threshold L2). Note that S4 is executed in order to detect a current leakage between the power supply circuit of the logic unit 81 and a power supply circuit of the driver actuator 82. When the print controller 202 determines that the voltage VHT equal to or below the threshold L2, the print controller 202 determines whether or not the voltage VH is equal to or below a predetermined threshold L3 (see FIG. 11) (S5). Specifically, the print controller 202 determines whether or not the third monitor voltage inputted from the third voltage divider circuit 603 is equal to or below a predetermined level L (which corresponds to the threshold L3). Note that S5 is executed in order to detect a current leakage between the power supply circuit of the logic unit 81 and a power supply circuit of the heater/sub-heater unit 83.

When the print controller 202 determines in S5 that the voltage VH is equal to or below the threshold L3, the print controller 202 supplies the voltage VHT (5 V) to the driver actuator 82 by using the second supply line L2 as a specified supply line (S6). Then, after a lapse of a time period (T2) necessary for rise of the voltage VHT (S7), the print controller 202 determines whether or not the voltage VHT is equal to or above a predetermined threshold H2 (see FIG. 11) (S8). Specifically, the print controller 202 determines whether or not the second monitor voltage inputted from the second voltage divider circuit 602 is equal to or above a predetermined level H (which corresponds to the threshold H2). Note that S8 is executed in order to detect a current leakage between the power supply circuit of the driver actuator 82 and the GND. When the print controller 202 determines that the voltage VHT is equal to or above the threshold H2, the print controller 202 determines whether or not the voltage VH is equal to or below the predetermined threshold L3 (S9). Specifically, the print controller 202 determines whether or not the third monitor voltage inputted from the third voltage divider circuit 603 is equal to or below a predetermined level L (which corresponds to the threshold L3). Note that S9 is executed in order to detect a current leakage between the power supply circuit of the driver actuator 82 and the power supply circuit of the heater/sub-heater unit 83. When the print controller 202 determines in S9 that the voltage VH is equal to or below the threshold L3, the print controller 202 supplies the voltage VH (28 V) to the heater/sub-heater unit 83 by using the third supply line L3 as a specified supply line (S10). Then, after a lapse of a time period (T3) necessary for rise of the voltage VH (S11), the print controller 202 determines whether or not the voltage VH is equal to or above a predetermined threshold H3 (see FIG. 11) (S12). Specifically, the print controller 202 determines whether or not the third monitor voltage inputted from the third voltage divider circuit 603 is equal to or above a predetermined level H (which corresponds to the threshold H3). Note that S12 is executed in order to detect a current leakage between the power supply circuit of the heater/sub-heater unit 83 and the GND.

When the print controller 202 determines in S12 that the voltage VH is equal to or above the threshold L3, the print controller 202 determines that no current leakage is taking place (S13). On the other hand, if the print controller 202 makes a negative determination in any of S3, S4, S5, S8, S9, and S12, the print controller 202 determines that a current leakage is taking place between any two out of the heater/sub-heater unit 83, the driver actuator 82, and the logic unit 81 (S14). When the print controller 202 determines the occurrence of the leakage current as described above, the print controller 202 interrupts the voltage supply to the print head 8 (S15), and then notifies a user of the occurrence of the current leakage (error notification) (S16).

Figure 11:
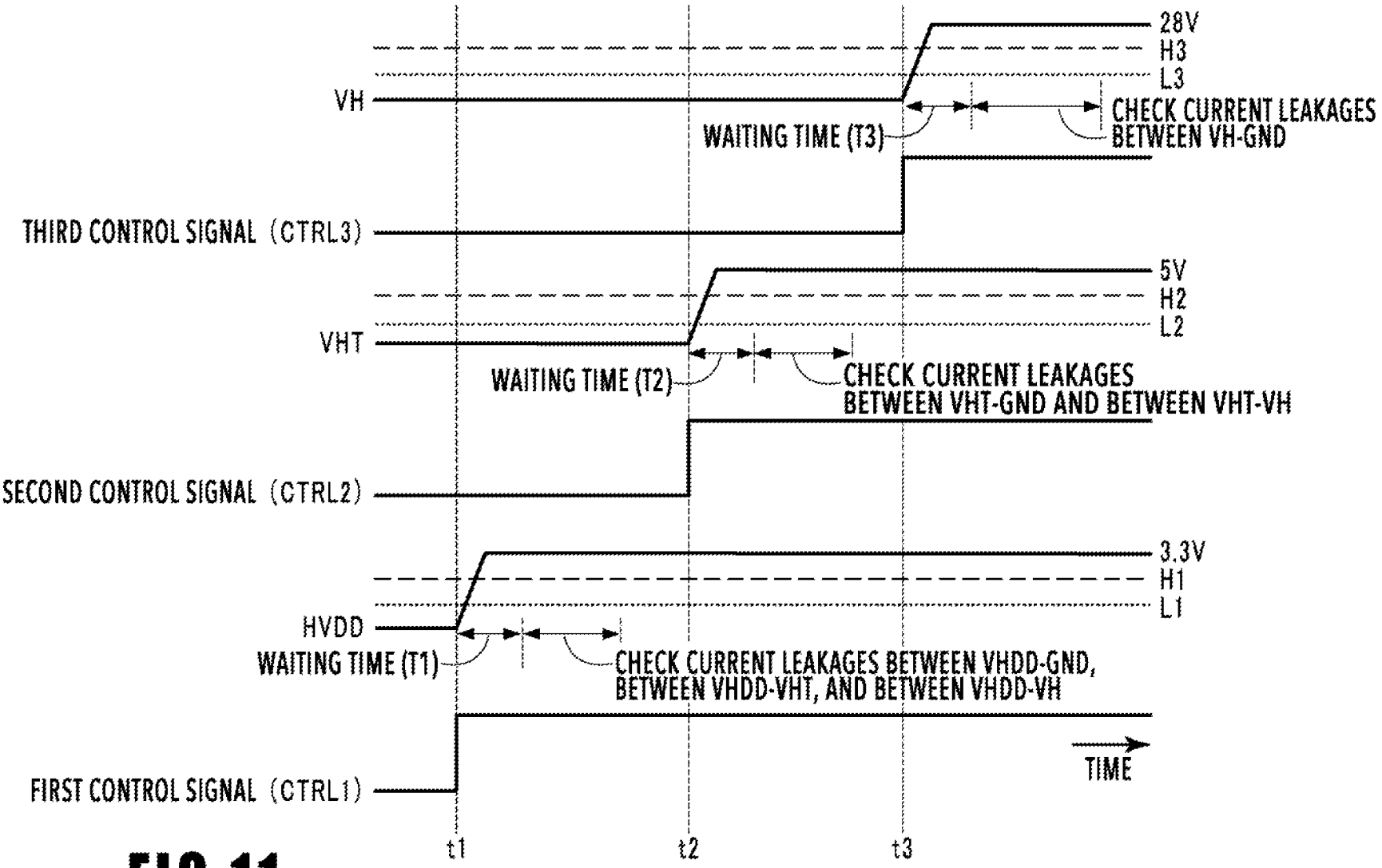
FIG. 11 is a timing chart for explaining the detection process when a current leakage does not occur.

FIG. 11 is a timing chart for explaining a specific example of the detection process when a current leakage does not take place.

At time t1, a first control signal (a CTRL1 signal) is outputted from the print controller 202. The first power supply circuit 604 is activated by the first control signal, and generates the voltage HVDD (3.3 V) and supplies the voltage HVDD to the logic unit 81 (S1). Then, the print controller 202 waits a lapse of the predetermined time period (T1) until the voltage HVDD becomes stable (S2). Thereafter, the print controller 202 outputs a second control signal (CTRL2) at time t2 on the condition that an affirmative determination is made in each of S3, S4, and S5. In other words, the second control signal is outputted on the condition that the voltage HVDD is equal to or above the threshold H1, the voltage VHT is equal to or below the threshold L2, and the voltage VH is equal to or below the threshold L3. The second power supply circuit 605 is activated based on the second control signal, and generates the voltage VHT (5 V) and supplies the voltage VHT to the driver actuator 82 (S6).

Then, the print controller 202 waits a lapse of the predetermined time period (T2) until the voltage VHT becomes stable (S2). Thereafter, the print controller 202 outputs a third control signal (CTRL3) at time t3 on the condition that an affirmative determination is made in each of S8 and S9. In other words, the third control signal is outputted on the condition that the voltage VHT is equal to or above the threshold H2 and the voltage VH is equal to or below the threshold L3. The third power supply circuit 606 is activated based on the third control signal, and generates the voltage VH and supplies the voltage VH to the heater/sub-heater unit 83 (S10). Then, the print controller 202 waits a lapse of the predetermined time period (T3) until the voltage VH becomes stable (S11). Thereafter, the print controller 202 determines that no current leakage is taking place on the condition that the voltage VH is equal to or above the threshold H3 (S12 and S13).

As described above, in this embodiment, the lowest voltage HVDD (the first voltage) is first supplied to the print head at the time of the inspection of the print head. In this instance, the print controller 202 compares the voltage on the first supply line of the first power supply circuit 604 with the threshold H1 (a second threshold), then compares the voltage on the second supply line of the second power supply circuit 605 with the threshold L2 (a first threshold), and then compares the voltage on the third supply line of the third power supply circuit 606 with the threshold L3 (a third threshold). When no current leakage is detected from results of these comparisons, the VHT (the second voltage) is supplied to the print head. In this instance, the print controller 202 compares the voltage on the second supply line of the second power supply circuit 605 with the threshold H2 (a fifth threshold), and compares the voltage on the third supply line of the third power supply circuit 606 with the threshold L3 (a fourth threshold). When no current leakage is detected from results of these comparisons, the highest voltage VH (the third voltage) is supplied to the print head. In this instance, the print controller 202 detects a current leakage by comparing the voltage on the third supply line of the third power supply circuit 606 with the threshold H3 (a sixth threshold). The third threshold and the fourth threshold do not always have to be set to the same threshold L3 as in this example, and may be set to different thresholds depending on the HVDD (the first voltage) and the VHT (the second voltage) to be supplied to the print head. In the meantime, since the HVDD (the first voltage), the VHT (the second voltage), and the VH (the third voltage) are supplied to the print head in increasing order, it is possible to conduct the inspection of the current leakage of the print head while minimizing damage in case of the occurrence of a current leakage.

Figure 12:
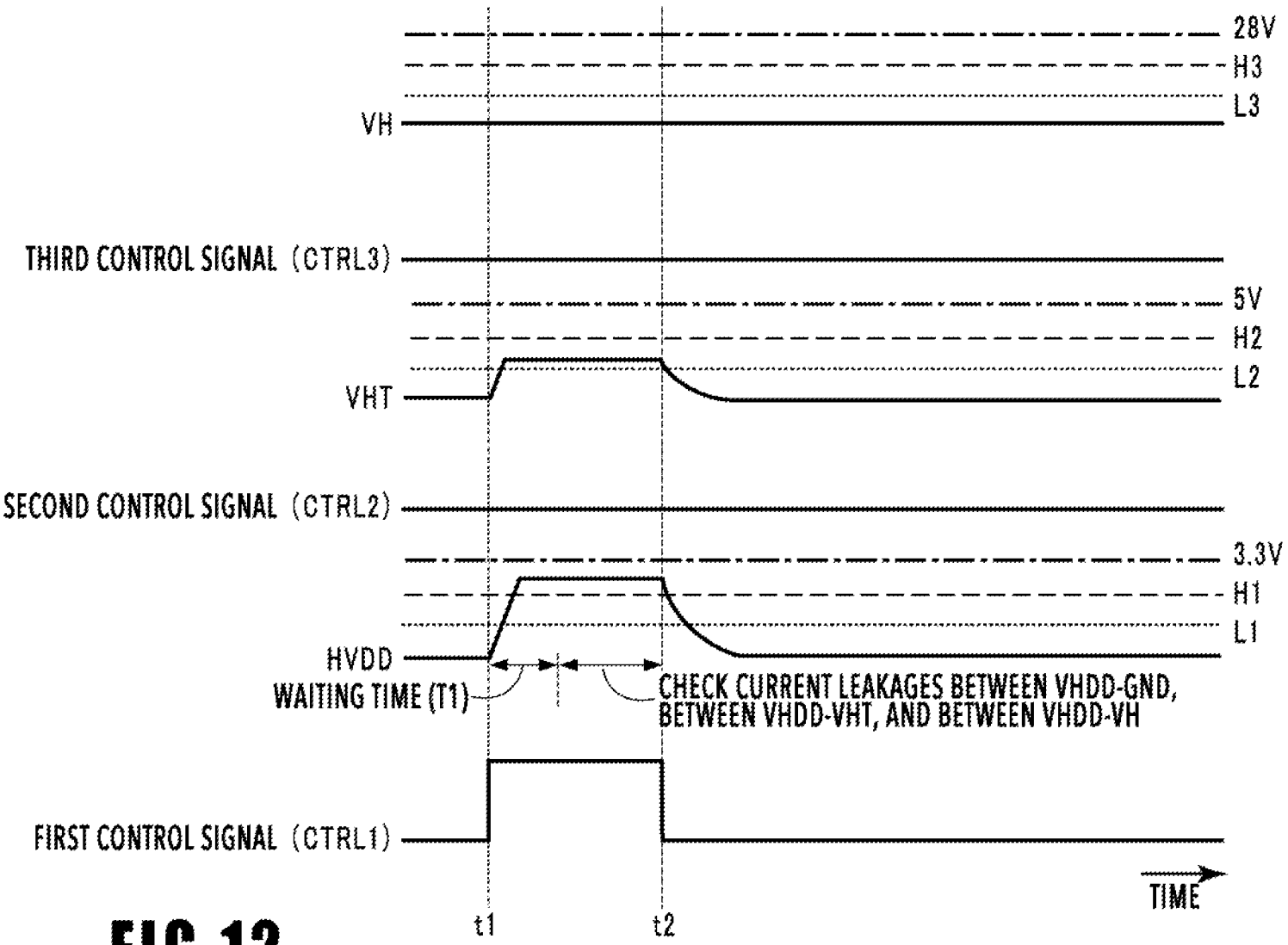
FIG. 12 is a timing chart for explaining the detection process when a current leakage occurs at one part of a circuit.

FIG. 12 is a timing chart for explaining a specific example of the process to detect a current leakage when a current leakage occurs between the power supply circuit of the driver actuator 82 and the power supply circuit of the logic unit 81 (between the HVDD and the VHT). Such a current leakage may occur when the power supply circuit of the driver actuator 82 is connected to the power supply circuit of the logic unit 81 due to adhesion of ink or adhesion of a dust particle, for instance. As a consequence of the output of the first control signal (the CTRL1 signal), the first power supply circuit 604 supplies the voltage HVDD (3.3 V) to the logic unit 81 (S1). Then, after waiting the lapse of the predetermined time period (T1) in S2, the voltage HVDD is determined to be equal to or above the threshold H1 in S3, and the voltage VHT is determined to exceed the threshold L2 in S4. As a result, it is determined in S14 that the current leakage has occurred between the driver actuator 82 and the logic unit 81, and the supply of all the power supply voltages to the print head 8 is interrupted in S15.

Figure 13:
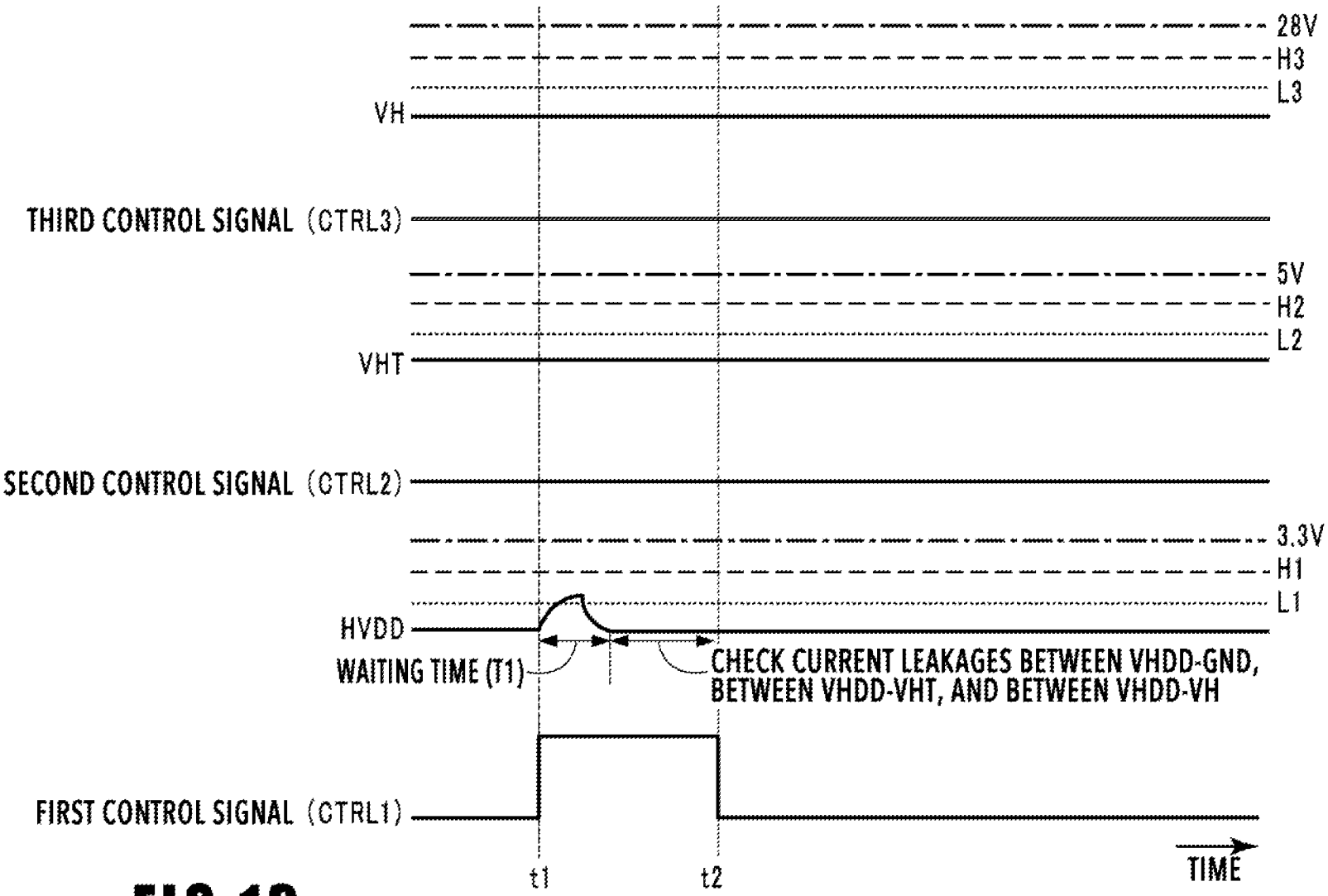
FIG. 13 is a timing chart for explaining the detection process when a current leakage occurs at another part of the circuit.

FIG. 13 is a timing chart for explaining the detection process when a current leakage occurs between the power supply circuit of the logic unit 81 and the ground (GND) (between the HVDD and the GND). Such a current leakage may occur when the power supply circuit of the logic unit 81 is connected to the GND due to adhesion of ink or adhesion of a dust particle, for instance. As a consequence of the output of the first control signal (the CTRL1 signal), the first power supply circuit 604 supplies the voltage HVDD (3.3 V) to the logic unit 81 (S1). Then, after waiting the lapse of the predetermined time period (T1) in S2, the voltage HVDD is determined to be below the threshold H1 in S3. When the voltage HVDD falls below the predetermined threshold as mentioned above, it is determined in S14 that the current leakage has occurred between the power supply circuit of the logic unit 81 and the ground, and the supply of all the power supply voltages to the print head 8 is interrupted in S15.

Figure 14:
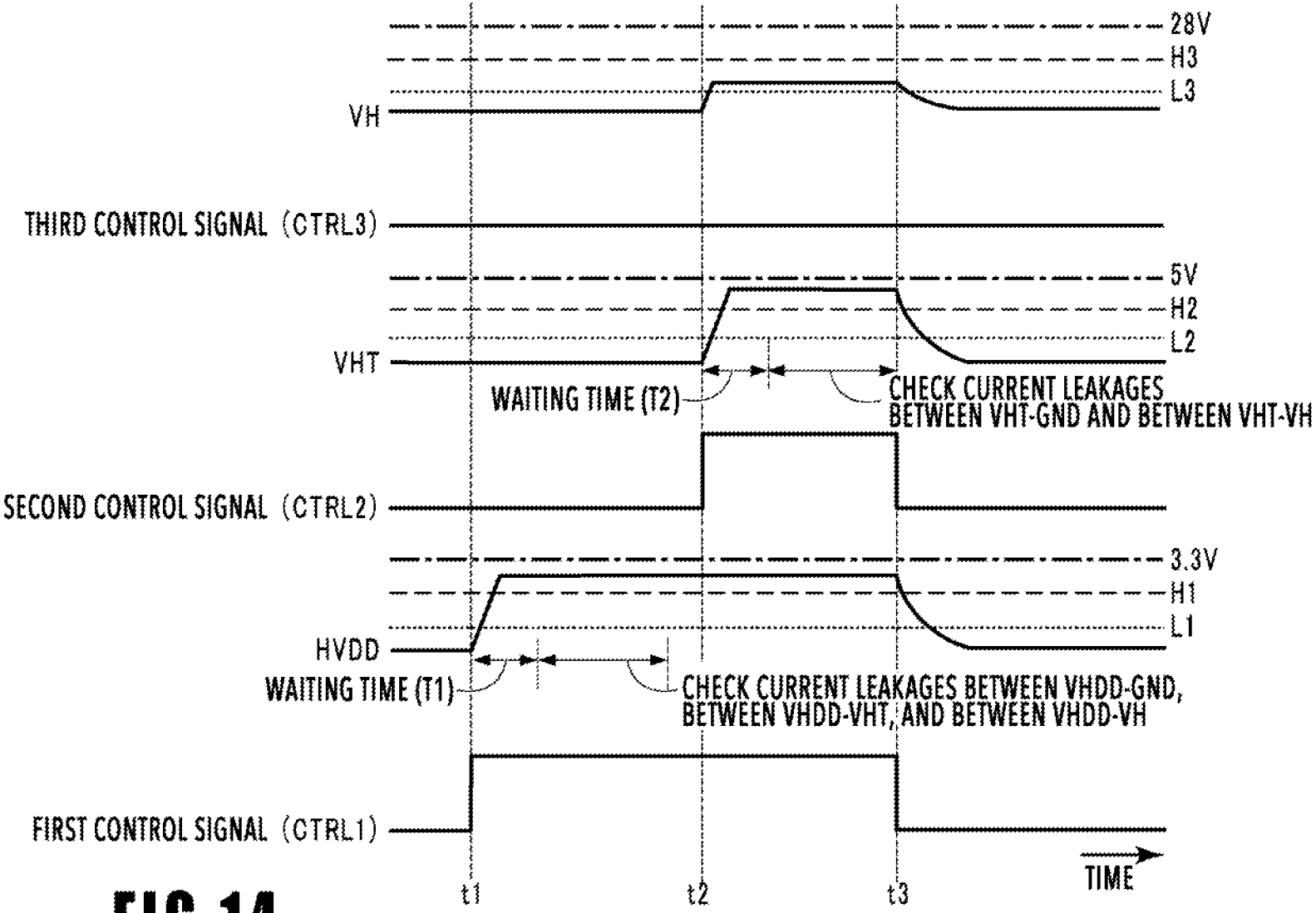
FIG. 14 is a timing chart for explaining the detection process when a current leakage occurs at still another part of the circuit.

FIG. 14 is a timing chart for explaining the detection process when a current leakage occurs between the power supply circuit of the driver actuator 82 and the power supply circuit of the heater/sub-heater unit 83 (between the VHT and the VH). Such a current leakage may occur when the power supply circuit of the driver actuator 82 is connected to the power supply circuit of the heater/sub-heater unit 83 due to adhesion of ink or adhesion of a dust particle, for instance. As a consequence of the output of the first control signal (the CTRL1 signal), the first power supply circuit 604 supplies the voltage HVDD (3.3 V) to the logic unit 81 (S1). Then, after waiting the lapse of the predetermined time period (T1) in S2, the voltage HVDD is determined to be equal to or above the threshold H1 in S3, then the voltage VHT is determined to be equal to or below the threshold L2 in S4, and then the voltage VH is determined to be equal to or below the threshold L3 in S5. As a consequence of the output of the second control signal (the CTRL2 signal), the second power supply circuit 605 supplies the voltage VHT (5 V) to the driver actuator 82 (S6). Then, after waiting the lapse of the predetermined time period (T2) in S7, the voltage VHT is determined to be equal to or above the threshold H2 in S8 and the voltage VH is determined to exceed the threshold L3 in S9. As a result, it is determined in S14 that the current leakage has occurred between the driver actuator 82 and the heater/sub-heater unit 83, and the supply of all the power supply voltages to the print head 8 is interrupted in S15.

As described above, in this embodiment, when the power supply voltages are supplied to the print head through the three circuits, the occurrence or the non-occurrence of the current leakage between each pair of those circuits corresponding to the power supply voltages is checked. Moreover, the supply of all the power supply voltages to the print head is interrupted in case of the occurrence of the current leakage. Thus, it is possible to prevent the print head from causing a secondary failure. By carrying out the process of this embodiment, it is possible to prevent a problem such as a failure in the logic unit 81 due to the occurrence of a sneak current at a voltage of 28V from the heater/sub-heater unit 83 that needs 28 V to the logic unit 81 that needs 3.3 V, for example.

(Other Embodiments)

The circuits for supplying the power supply voltages are not limited only to three circuits. The present invention is also applicable to a configuration to supply the power supply voltages by using two circuits or by using four or more circuits. In such a case, it is preferable to supply different power supply voltages to the print head in increasing order at the time of inspection of the print head so as to minimize damage in case of the occurrence of a current leakage. In the meantime, process actions in case of detection of the current leakage are not limited only to the interruption of supply of the voltages (S15) and the error notification (S16). Specifically, it is also possible to execute various related actions including an action to inform of the occurrence of the current leakage by using a sound and the like. Meanwhile, the timing to conduct the process to detect a current leakage as shown in FIGS. 10A and 10B is not limited to a particular timing, and the process may be conducted at any time when the printing apparatus is in operation aside from the start-up of the printing apparatus (when the printing apparatus is turned on). For instance, the process to detect a current leakage may be conducted at the timing when the occurrence of a current leakage is predicted.

The present invention is also broadly applicable to other liquid ejection apparatuses using liquid ejection heads capable of ejecting various liquids. For example, the present invention is applicable to liquid ejection apparatuses configured to perform various processes (printing, machining, and the like) on various media (such as sheets) by using liquid ejection heads capable of ejecting liquids. In the meantime, the present invention is also applicable to devices other than printing heads.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-064957 filed Mar. 29, 2018, which is hereby incorporated by reference herein in its entirety.

What is claimed is:

1. A printing apparatus configured to perform printing by using a print head, the printing apparatus comprising:

a first power supply configured to supply a first voltage to the print head through a first supply line;

a second power supply configured to supply a second voltage to the print head through a second supply line; and a control unit configured to supply the first voltage from the first power supply without supplying a voltage from the second power supply at the time of an inspection of the print head, and to execute a process action concerning a current leakage when a voltage exceeding a predetermined first threshold is generated on the second supply line, wherein the control unit executes the process action when a voltage on the first supply line is below a predetermined second threshold at the time of the inspection.

2. The printing apparatus according to claim 1, wherein the process action includes interruption of supply of the voltages to the print head.

3. The printing apparatus according to claim 1, further comprising:

a notification unit configured to notify of occurrence of a current leakage, wherein the process action includes notification of the occurrence of the current leakage by using the notification unit.

4. The printing apparatus according to claim 1, wherein the first voltage is lower than the second voltage.

5. The printing apparatus according to claim 1, further comprising:

a third power supply configured to supply a third voltage to the print head through a third supply line, wherein the control unit does not supply a voltage from the third power supply at the time of the inspection, and executes the process action when a voltage exceeding a predetermined third threshold is generated on the third supply line.

6. The printing apparatus according to claim 5, wherein the control unit supplies the second voltage from the second power supply without supplying a voltage from the third power supply unless a voltage exceeding the first threshold is generated on the second supply line and a voltage exceeding the third threshold is generated on the third supply line at the time of the inspection, and executes the process action when a voltage exceeding a predetermined fourth threshold is generated on the third supply line.

7. The printing apparatus according to claim 6, wherein the control unit executes the process action when a voltage on the second supply line is below a predetermined fifth threshold in a case where the second voltage is supplied from the second power supply without supplying the voltage from the third power supply.

8. The printing apparatus according to claim 7, wherein the control unit executes the process action when a voltage on the third supply line is below a predetermined sixth threshold in a case where the third voltage is supplied from the third power supply.

9. The printing apparatus according to claim 5, wherein the second voltage is lower than the third voltage, and the first voltage is lower than the second voltage.

10. The printing apparatus according to claim 1, wherein the print head is an inkjet print head configured to perform printing by ejecting ink.

11. A printing apparatus configured to perform printing by using a print head, the printing apparatus comprising:

a plurality of power supplies configured to supply different voltages to the print head through a plurality of supply lines; and a control unit configured to supply a voltage only from a specific supply line out of the plurality of supply lines to the print head at the time of an inspection of the print head, and to execute a process action on a current leakage when a voltage exceeding a predetermined threshold is generated on a supply line out of the plurality of the supply lines which supplies a higher voltage than the voltage supplied from the specific supply line, wherein the threshold varies depending on the voltage on the specific supply line.

12. The printing apparatus according to claim 11, wherein the control unit changes the specific supply line.

* * * * *